US010160123B2

(12) United States Patent
Cepek

(10) Patent No.: US 10,160,123 B2
(45) Date of Patent: Dec. 25, 2018

(54) KIT FOR MODIFYING A CORRUGATED SIGN ASSEMBLY

(71) Applicant: William Barry Cepek, Davie, FL (US)

(72) Inventor: William Barry Cepek, Davie, FL (US)

( * ) Notice: Subject to any disclaimer, the term of this patent is extended or adjusted under 35 U.S.C. 154(b) by 0 days.

(21) Appl. No.: 14/665,119

(22) Filed: Mar. 23, 2015

(65) Prior Publication Data

US 2015/0194079 A1 Jul. 9, 2015

Related U.S. Application Data

(62) Division of application No. 13/933,824, filed on Jul. 2, 2013, now Pat. No. 8,984,783.

(51) Int. Cl.

| | |
|---|---|
| ***B26B 3/08*** | (2006.01) |
| ***G09F 7/18*** | (2006.01) |
| ***G09F 7/22*** | (2006.01) |

(52) U.S. Cl.

CPC ..... *B26B 3/08* (2013.01); *G09F 7/18* (2013.01); *G09F 7/22* (2013.01); *G09F 2007/1804* (2013.01); *G09F 2007/1826* (2013.01); *G09F 2007/1834* (2013.01); *Y10T 29/49826* (2015.01)

(58) Field of Classification Search

CPC ..... G09F 7/18; G09F 7/22; G09F 2007/1804; G09F 2007/1826; G09F 2007/1834; B26B 3/08; B26B 5/005; B26B 5/008

USPC ... 30/2, DIG. 3, DIG. 8, 280, 282, 284–287, 30/290, 294, 295, 314, 315; 40/607.01–607.12; D8/98, 99; 248/165; 83/870

See application file for complete search history.

(56) References Cited

U.S. PATENT DOCUMENTS

| | | | | | |
|---|---|---|---|---|---|
| 40,163 | A | * | 10/1863 | Fitch | B26B 27/00 30/294 |
| 52,223 | A | * | 1/1866 | Sunderland | B26B 27/00 30/294 |
| 65,130 | A | * | 5/1867 | Spelman | B26B 27/00 30/294 |
| 128,010 | A | * | 6/1872 | Bernard | B26B 29/02 30/295 |
| 222,384 | A | * | 12/1879 | Cogswell | A01G 23/099 30/294 |
| 449,031 | A | * | 3/1891 | Bernard | B26B 29/02 30/295 |
| 520,435 | A | * | 5/1894 | Jones | B26B 5/005 30/287 |

(Continued)

*Primary Examiner* — Jason Daniel Prone
(74) *Attorney, Agent, or Firm* — The Concept Law Group, PA; Scott D. Smiley; Scott M. Garrett

(57) ABSTRACT

A corrugated sign modification kit that includes a handheld cutting device with a handle with a first end, a second end, and a handle length separating the first and second ends, a first blade member, and a blade guide member. The first blade member is coupled to the handle and has a cutting edge that faces in a longitudinal direction of the handle, extends outwardly away from the handle, and has a width of less than approximately 1 inch separating its proximal and distal ends. The blade guide member is coupled to the distal end of the first blade member, is orientated in a substantially parallel direction to the longitudinal direction of the handle, and has a distal end protruding to a point in front of the cutting edge so as to define a channel to guide inserted objects within the channel to the cutting edge.

13 Claims, 9 Drawing Sheets

(56) References Cited

U.S. PATENT DOCUMENTS 521,115 A * 6/1894 Hopper ..... B26B 27/00 30/294
541,963 A * 7/1895 Carpenter ..... B26B 27/00 30/294
561,092 A * 6/1896 Cooke ..... B26B 27/00 30/294
642,689 A * 2/1900 Garllus ..... B26B 27/00 30/294
742,324 A * 10/1903 Howley et al. ..... B26B 5/005 30/287
757,317 A * 4/1904 Kinney ..... B26B 27/00 30/294
846,135 A * 3/1907 O'Brien ..... B26B 27/00 30/294
847,815 A * 3/1907 Pigg ..... B26B 29/02 30/295
940,857 A * 11/1909 Cumms ..... B26B 27/00 30/294
992,439 A * 5/1911 O'Brien ..... B26B 27/00 30/294
994,534 A * 6/1911 Fletcher ..... A61B 17/54 30/280
1,057,090 A * 3/1913 Randall ..... B26B 5/005 30/287
1,148,552 A * 8/1915 Tingle ..... B26B 5/005 30/287
1,174,348 A * 3/1916 Redman ..... B26B 29/02 30/286
1,244,746 A * 10/1917 Kinzel ..... A01B 1/20 30/314
1,278,680 A * 9/1918 Klaffert ..... A01G 3/06 30/315
1,309,746 A * 7/1919 Reed ..... B26B 5/005 30/287
1,398,850 A * 11/1921 Franco ..... A01B 1/16 30/314
1,402,097 A * 1/1922 Schwartz, Jr. ..... B29B 17/0206 30/294
1,411,899 A * 4/1922 Baker ..... B23D 49/11 83/835
1,437,199 A * 11/1922 Same ..... A01B 1/16 30/314
1,498,753 A * 6/1924 Rendlich ..... B26B 3/00 30/286
1,516,789 A * 11/1924 Rassner ..... B26B 5/005 30/314
1,553,449 A * 9/1925 Kennedy ..... B26B 27/005 30/2
1,562,429 A * 11/1925 Unsinger ..... B26B 27/005 30/2
1,566,878 A * 12/1925 Jones ..... A47F 13/045 30/290
1,652,583 A * 12/1927 Sato ..... B43L 23/06 30/290
1,679,806 A * 8/1928 Bockstadter ..... A01B 1/06 30/314
1,687,986 A * 10/1928 Miller ..... A01B 1/08 172/381
1,748,869 A * 2/1930 Drennan ..... B21F 11/00 30/294
1,770,951 A * 7/1930 Smith ..... B44C 7/025 30/287
1,821,716 A * 9/1931 Kusiv ..... D06H 7/04 30/294
1,986,016 A * 1/1935 Royston ..... A41H 31/005 30/DIG. 8
2,017,369 A * 10/1935 McGhee ..... A01G 23/099 30/294
2,098,123 A * 11/1937 Wood ..... B65H 73/00 30/294
2,198,814 A * 4/1940 Hart ..... A22B 5/205 30/286
2,235,342 A * 3/1941 Turner ..... A47J 17/06 30/294
2,274,978 A * 3/1942 Currier ..... B26D 1/105 30/294
2,471,334 A * 5/1949 Levin ..... B26B 5/006 30/2
2,517,840 A * 8/1950 Chatlos ..... B26B 9/02 30/314
2,542,582 A * 2/1951 Schwork ..... B25C 11/02 30/314
2,555,142 A * 5/1951 Levin ..... B26B 5/006 30/2
2,601,414 A * 6/1952 Mittelstaedt ..... B44C 7/08 30/294
2,637,899 A * 5/1953 Conklin ..... A47J 17/04 30/282
2,680,255 A * 6/1954 Potter ..... B23D 79/06 30/294
2,686,360 A * 8/1954 Fisher ..... B26B 27/005 30/2
2,686,969 A * 8/1954 Furey ..... B23D 29/023 30/2
2,743,519 A * 5/1956 Hazelton ..... A47J 17/04 30/294
2,764,814 A * 10/1956 Jecker ..... A41H 31/005 30/294
3,009,248 A * 11/1961 Tilly ..... B43M 7/002 30/294
3,100,935 A * 8/1963 Leafe ..... A41H 31/005 30/294
3,187,354 A * 6/1965 Frisbie ..... B26B 23/00 30/294
3,241,236 A * 3/1966 Capps ..... A22C 21/063 30/287
3,365,798 A * 1/1968 Cunningham ..... A61F 15/02 30/287
3,380,159 A * 4/1968 Winston ..... B26B 27/005 30/294
3,383,768 A * 5/1968 Hamilton ..... B43M 7/002 30/287
3,439,420 A * 4/1969 Erickson ..... B26B 5/005 30/294
3,486,228 A * 12/1969 James ..... E04D 15/003 30/294
3,610,246 A * 10/1971 Salmon ..... A61B 17/3213 30/294
3,613,241 A * 10/1971 Allen ..... B26B 27/00 30/294
3,672,054 A * 6/1972 Kaufman ..... A61B 17/3201 30/294
3,673,687 A * 7/1972 Phillips ..... B26B 3/00 30/294
3,751,806 A * 8/1973 Patrick ..... B26B 27/00 30/294
3,831,274 A * 8/1974 Horrocks ..... H02G 1/1217 30/294
3,918,158 A * 11/1975 Debski ..... B26B 3/08 30/314
3,972,117 A * 8/1976 Fogg ..... B26B 27/00 30/287
3,975,822 A * 8/1976 Mabus ..... A41H 31/005 30/294
4,062,117 A * 12/1977 Coleman ..... B60R 22/32 30/294
4,064,627 A * 12/1977 Zanfini ..... B26B 5/005 30/287
4,134,206 A * 1/1979 Beermann ..... B26B 5/006 30/294
D254,243 S * 2/1980 Florian ..... 30/294
4,198,751 A * 4/1980 Egbert ..... A22C 25/006 30/294
D269,154 S * 5/1983 Freedman ..... 30/294
4,432,138 A * 2/1984 Piccolo, Jr. ..... B26B 27/00 30/294
4,604,804 A * 8/1986 Sparks ..... B26B 5/00 30/294

(56) References Cited

U.S. PATENT DOCUMENTS 4,631,829 A * 12/1986 Schmidt ..... B26B 5/006 30/2
4,682,417 A * 7/1987 Henslin ..... B27L 7/00 30/294
4,805,307 A * 2/1989 Lucas, Jr. ..... A01G 3/00 30/294
5,122,152 A * 6/1992 Mull ..... A61B 17/06161 30/DIG. 8
5,142,780 A * 9/1992 Brewer ..... H02G 1/1229 30/294
5,359,778 A * 11/1994 Seber ..... B26B 3/06 30/294
5,387,222 A * 2/1995 Strickland ..... A61B 17/32003 30/294
5,412,871 A * 5/1995 Reyburn ..... B26B 27/005 30/2
5,419,044 A * 5/1995 Valliere ..... B67B 7/30 30/2
5,485,677 A * 1/1996 Seber ..... B26B 3/06 30/294
5,636,845 A * 6/1997 Newnam ..... F42B 6/08 30/344
5,829,321 A * 11/1998 Domenico ..... B26B 3/00 30/294
5,852,874 A * 12/1998 Walker ..... B26B 29/02 30/2
5,896,667 A * 4/1999 Hawkins ..... B26B 1/00 30/2
6,029,355 A * 2/2000 Carlin ..... B26D 3/001 30/287
6,058,608 A * 5/2000 Wruck ..... B26B 29/00 30/286
6,085,452 A * 7/2000 Davis ..... G01C 15/06 40/607.03
6,182,364 B1 * 2/2001 Reyburn ..... B26B 5/00 30/2
6,513,249 B2 * 2/2003 Linton ..... B26B 3/04 30/2
6,711,824 B2 * 3/2004 Hruska ..... A01F 29/005 30/294
D540,647 S * 4/2007 Ireland ..... D8/98
D547,451 S * 7/2007 Asfora ..... D24/133
D586,197 S * 2/2009 Della Polla ..... D8/99
7,533,595 B2 * 5/2009 Domenico ..... B26B 3/08 30/286
7,870,675 B1 * 1/2011 Della Polla ..... B26B 29/00 30/2
D636,248 S * 4/2011 Still ..... D8/98
7,958,639 B2 * 6/2011 Ireland ..... B26B 3/00 30/2
D649,001 S * 11/2011 Still ..... D8/98
D664,417 S * 7/2012 Still ..... D8/98
8,608,765 B1 * 12/2013 Jurbala ..... A61B 17/32003 606/170
8,771,304 B1 * 7/2014 Jurbala ..... A61B 17/32003 606/170
8,782,909 B1 * 7/2014 Davis ..... B26B 5/003 30/2
8,984,783 B2 * 3/2015 Cepek ..... G09F 7/22 40/607.03
2005/0039363 A1 * 2/2005 Galey ..... G09F 15/00 40/607.03
2005/0060894 A1 * 3/2005 Armstrong ..... B26B 3/00 30/294
2005/0102844 A1 * 5/2005 Addis ..... B26B 5/00 30/299
2006/0060040 A1 * 3/2006 Wichner ..... B26B 27/00 30/294
2006/0288588 A1 * 12/2006 Morabito ..... A01B 1/00 30/294
2007/0157496 A1 * 7/2007 Scribner ..... G09F 15/00 40/607.05
2008/0016702 A1 * 1/2008 Domenico ..... B26B 3/08 30/294
2008/0178474 A1 * 7/2008 Spencer ..... A22B 5/168 30/294

* cited by examiner

100

200

524
518
502
506
500

508
504
510
522
508

500
514
516
524
510
512
522

500
524
508
520
522

500
524
508
520
522

500
524
508
520
522

500
524
508
520
522

500
524
508
520
522

508

520
508

520
508

520
508

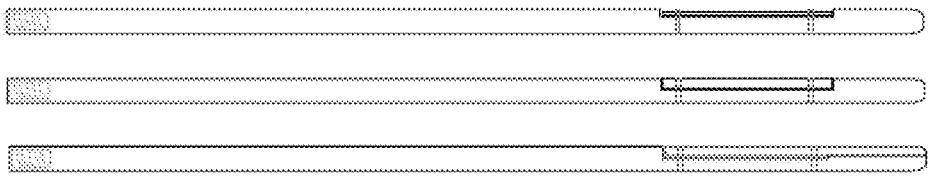
FIG. 8a
FIG. 8b
FIG. 8c
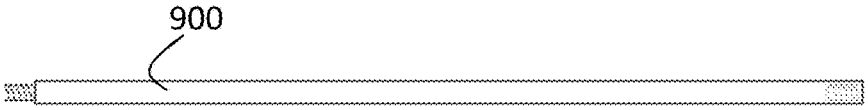
FIG. 9
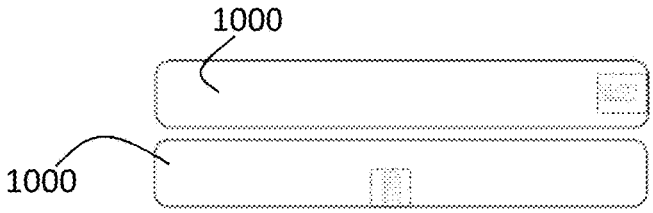
FIG. 10
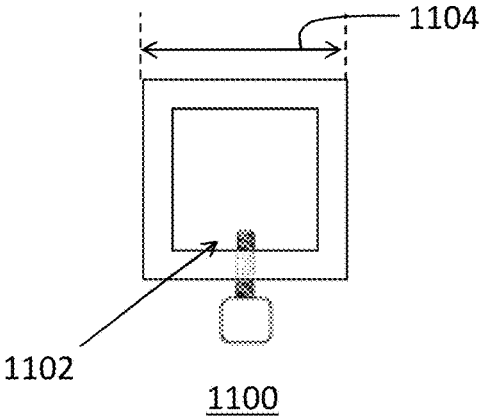
FIG. 11

KIT FOR MODIFYING A CORRUGATED SIGN ASSEMBLY

CROSS-REFERENCE TO RELATED APPLICATION

This application is a divisional of U.S. Nonprovisional patent application Ser. No. 13/933,824, filed on Jul. 2, 2013, which is now published as U.S. Patent Application Publication No. 2015/0007471, the entirety of which is incorporated herein by reference.

FIELD OF THE INVENTION

The present invention relates generally to a method and kit for modifying a corrugated sign assembly to increase its stability, and more particularly relates to a method and kit for altering a configuration of a corrugated sign for attachment to a support arm.

BACKGROUND OF THE INVENTION

Corrugated signs, such as yard signs, are well known in the art and are used extensively in the advertising industry for displaying advertisements because of their low cost and smooth professional appearance. For example, the signs are commonly employed by real estate agents for advertising home sales and rentals by placing a corrugated sign on a frame post in the front yard of the house. For another example, corrugated signs are commonly placed in grassy medians to advise drivers in opposite directions of temporary traffic flows and special events.

These signs are commonly held upright by way of two arms whereby each arm slides into a single channel of the corrugated sign. In some cases, such as U.S. Pat. No. 6,170,183, the rods may apply a slight pressure against the single corrugation channel to support the sign above the ground merely by compression fit between the rod and the single corrugation channel. The problem with supporting the sign with a rod through a single corrugation channel is that the channel is limited in size, thereby limiting the size of the support. The size of the channel typically dictates the size and strength of the support art that is permitted to be used in connection with the sign. As a result, the support arm(s) are weak and susceptible to damage when exposed to environments having harsh weather conditions, e.g., wind, snow, and rain. To that end, strong winds cause the support arms to either buckle under the weight or become dislodged from their placement location. The problem is exacerbated as the surface area of the sign increases because the air resistance increases. To overcome this problem, the prior corrugated signs have included a channel affixed to the outer surface of the corrugated sign, i.e., one face of the sign, which is unattractive and ruins the smooth professional appearance. Those known corrugated signs also have channels that are difficult to modify because the openings are very small, have walls of a material that is difficult to cut, and there is limited availability of tools capable of adjusting the channel widths to accommodate any larger sized support arm(s). Additionally, attaching the sign to a rod or other securement member on the face of the sign covers or significantly distorts the advertising of the sign face.

Therefore, a need exists to overcome the problems with the prior art as discussed above.

SUMMARY OF THE INVENTION

The invention provides a method and kit for modifying a corrugated sign assembly that overcomes the hereinaforementioned disadvantages of the heretofore-known devices and methods of this general type such that the corrugated sign can be implemented to accept a support arm sized to enter two or more channels created by modifying the internal corrugated structure of said sign, as further described herein.

With the foregoing and other objects in view, there is provided, in accordance with the invention, a method of increasing the stability of a corrugated display apparatus that defines a plurality of lower openings and having a plurality of walls at least partially defining a plurality of channels, each of the plurality of channels having a channel width. The plurality of channels span from one of the plurality of lower openings toward an upper end of the display apparatus. The method includes providing a cutting device having a first end, a second end, a handle length separating the first and second ends, and a blade member coupled along the handle length. The method also includes cutting a portion of at least one of the plurality of walls with the blade member to combine at least two of the plurality of channels adjacent to the cut portion of the at least one of the plurality of walls to create an enlarged channel, and then inserting a post-like member into the enlarged channel, the post-like member securely retained within the enlarged channel. This process creates a display apparatus that is operable to not only support signs of a greater weight but also increases the overall sign stability when placed in environments with inclement weather.

In accordance with a further feature of the present invention, the post-like member includes a proximal end, a distal end, and a length separating the proximal and distal ends, the length having a width greater than at least one of the at least two of the plurality of channels adjacent to the cut portion of the at least one of the plurality of walls.

In accordance with another feature, an embodiment of the present invention includes the enlarged channel having an enlarged channel width greater than an average width of individual channels within the plurality of channels.

In accordance with yet another feature, an embodiment of the present invention includes providing a post-like member with a width greater than a width of any one of the plurality of channels.

In accordance with a further feature of the present invention, each of the plurality of channels extend from one of the plurality of lower openings, through the display apparatus, and out one of a plurality of upper openings defined by the upper end of the display apparatus.

In accordance with a further feature, an embodiment of the present invention also includes inserting the post-like member into the enlarged channel, the insertion of the post-like member distorting the shape of a corrugated display apparatus corresponding to the enlarged channel.

In accordance with yet another exemplary feature, an embodiment of the present invention also includes providing the cutting device with a depth stopping device fixedly coupled thereto and then inserting the post-like member into the enlarged channel until the depth stopping device is substantially adjacent with a lower end of the corrugated display apparatus, the lower end defining the plurality of lower openings.

In accordance with an additional feature, an embodiment of the present invention includes providing a cutting device with two blade members coupled along the handle length, each blade member extending outwardly away from a handle of the cutting device in an opposing orientation from one another and cutting a portion of two of the plurality of walls with the blade members to combine two of the plurality of channels adjacent to the cut portions of the two of the plurality of walls to create the enlarged channel.

In accordance with a further feature of the present invention, the plurality of walls are of a non-metallic material.

In accordance with the present invention, a corrugated sign modification kit also includes a handheld cutting device for cutting a portion of at least one of a plurality of walls of a corrugated sign. The handheld cutting device includes a handle with a first end, a second end, and a handle length separating the first and second ends and a first blade member (1) with a proximal end coupled to the handle along the handle length, a distal end, and a cutting edge separating the proximal and distal ends, the cutting edge facing in a longitudinal direction of the handle, (2) extending outwardly away from the handle, and (3) with a width of less than approximately 1 inch separating the proximal and distal ends. The kit further includes a post-like member that has a distal end, a proximal end, and a post-like member length separating the distal and proximal ends of the post-like member, the post-like member length of a length greater than the handle length. The post-like member has a portion along post-like member length with a width separating the outer-most extents of the post-like member that is greater than the first blade member width. The kit also includes a package housing the handheld cutting device and the post-like member. The "housing" may include all products included as one package or may include components that are packaged separately and distributed together. The package housing may also include the cutting device.

In accordance with another feature, an embodiment of the present invention also includes the post-like member having a cylindrical shape.

In accordance with yet another feature, an embodiment of the present invention also includes a depth stopping device having a portion removably fixedly couplable to the handle and a width greater than the first blade member width.

In accordance with a further feature of the present invention, the first blade member has a blade guide member coupled thereto, the blade guide member extending outwardly away from first blade member in the direction normal to a portion of the first blade member cutting edge.

In accordance with an additional feature, an embodiment of the present invention includes the handheld cutting device including a second blade member: (1) with a proximal end coupled to the handle along the handle length, a distal end, and a cutting edge separating the proximal and distal ends, the cutting edge facing in the longitudinal direction of the handle, (2) extending outwardly away from the handle in an opposing orientation from the first blade member, and (3) with a width of less than approximately 1 inch separating the proximal and distal ends of the second blade member.

In accordance with a further feature of the present invention, the first and second blade members include a blade guide member coupled thereto, the blade guide member extending outwardly away from first and second blade members in a direction normal to a portion of the cutting edge of the first and second blade members, respectively.

In accordance with the present invention, a modified corrugated display assembly is disclosed that includes a corrugated display apparatus with (1) an upper end, (2) a lower end defining a plurality of lower openings each with a lower opening width of substantially the same length to one another and at least one enlarged opening, the at least one enlarged opening having a width approximately at least twice a length of a plurality of lower opening widths, (3) a substantially planar outer surface with indicia communicating a message to a viewing public, (4) an inner surface, and (4) a corrugated wall structure separated by the outer and inner surfaces. The corrugated wall structure has a plurality of walls at least partially defining a plurality of channels, each of the plurality of channels with a channel width and spanning from one of the plurality of lower openings toward the upper end of the display apparatus. The corrugated wall structure also includes a plurality of walls at least partially defining at least one enlarged channel with an enlarged channel width and spanning from the at least one enlarged opening toward the upper end of the display apparatus, the enlarged channel width of approximately at least twice a length of a plurality of channel widths. The inventive modified corrugated display assembly also includes a post-like member securely retained within the at least one enlarged channel.

In accordance with a further feature of the present invention, the at least one enlarged opening is juxtaposed with the plurality of lower openings.

In accordance with yet another feature of the present invention, the at least one enlarged opening is juxtaposed on each side with the plurality of lower openings.

In accordance with an additional feature of the present invention, the at least one enlarged opening has a width approximately at least twice the length of each of the plurality of lower opening widths.

In accordance with yet a further feature of the present invention, the enlarged channel width of approximately at least twice the length of each of the plurality of channel widths.

Although the invention is illustrated and described herein as embodied in a method and kit for modifying a corrugated display apparatus, i.e., a sign, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances, unless otherwise indicated herein, these terms may include numbers that are rounded to the nearest significant figure and are of 5-10% deviation of the stated number.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIGS. 8*a-c* are side elevational views of the exemplary cutting devices in FIGS. 5*a-g* in accordance with embodiments of the present invention;

FIG. 9 is a side, partially cross-sectional, view of an exemplary extension member for the cutting devices in FIGS. 5*a-g* in accordance with an embodiment of the present invention;

FIG. 10 is a side, partially cross-sectional, view of exemplary handles for the cutting devices in FIGS. 5*a-g* in accordance with embodiments of the present invention;

FIG. 11 is a top plan view of a depth stopping device in accordance with an embodiment of the present invention;

DETAILED DESCRIPTION

Figure 1:
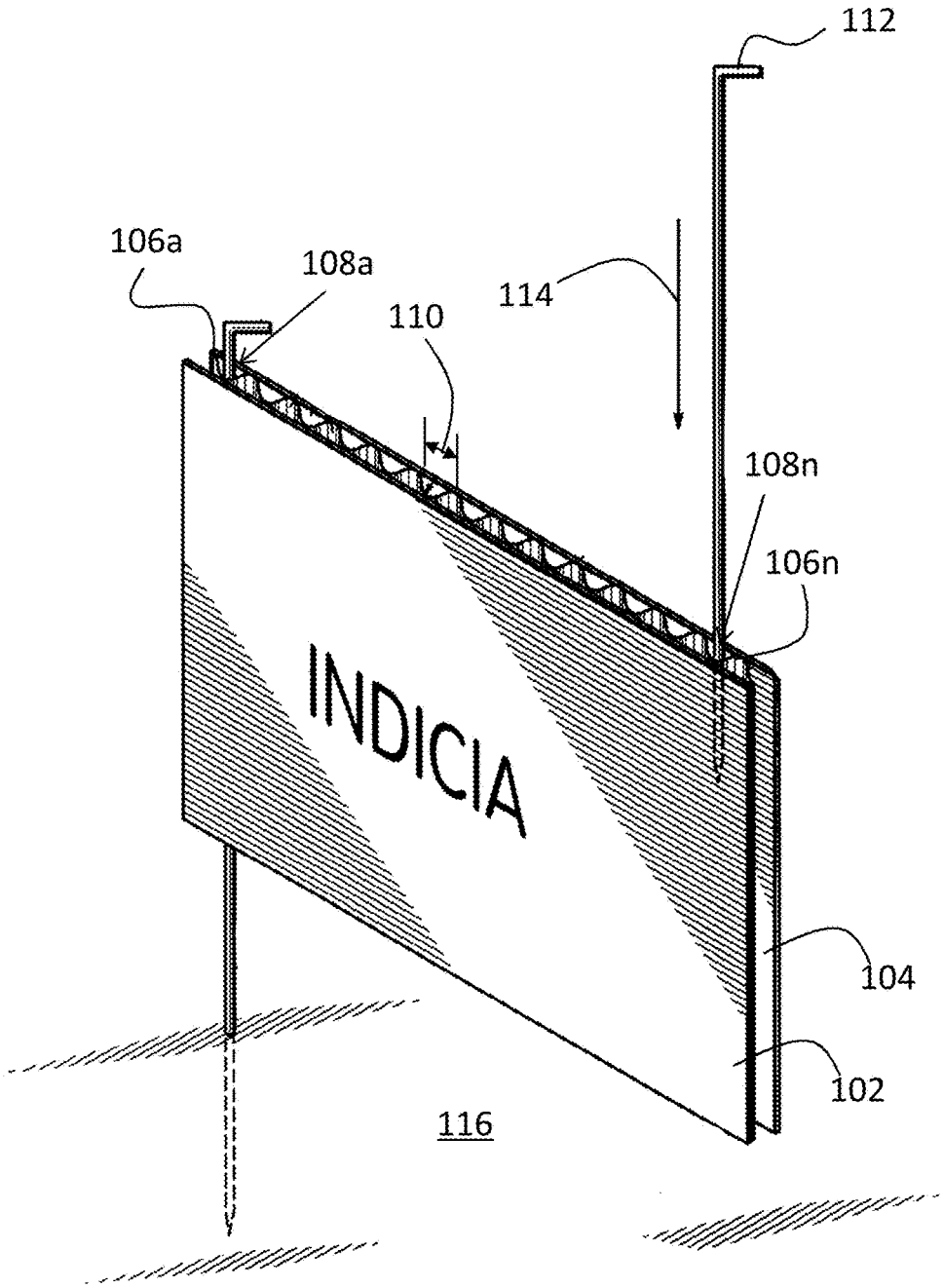
PRIOR ART FIG. 1
FIG. 1 is a prior art corrugated sign board.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method of modifying those standard corrugated signs by cutting the walls with a special cutting device, thereby combining the channels of the corrugated structure. As shown in FIG. 1, standard corrugated signs 100 include an outer face 102 that includes some indicia of advertising, message(s), or other content displayed for the viewing public and an inner face 104. The sign 100 has a plurality of walls 106*a-n* separating the outer and inner faces 102, 104, wherein "a" represents number of the referencing object and "n" represents any number of the referencing object determined by the user. These walls 106*a-n* define a plurality of channels 108*a-n*. These channels 108*a-n* may extend, or span, through the entire length of the sign (as shown in FIG. 1) or may extend partially through the sign. These channels 108*a-n* may be completely defined by the walls or partially defined by the walls and another portion of the sign, e.g., the outer and inner faces 102, 104. Most known corrugated signs have a width separating each of the plurality of channels 108*a-n*, also referred to herein as the first-sized width, (represented with the arrow 110), that are substantially similar in size, i.e., 5-10% deviation, from one another. Said another way, most of the channels 108*a-n* have the same size, extend the same length through the sign, and are generally uniform. As shown in FIG. 1, generally very thin posts 112 are placed through the channels (in the direction of the arrow 114) and staked into the ground surface 116. In other embodiments, the posts 112 are inserted through the lower portion of the corrugated sign 100.

Figure 2:
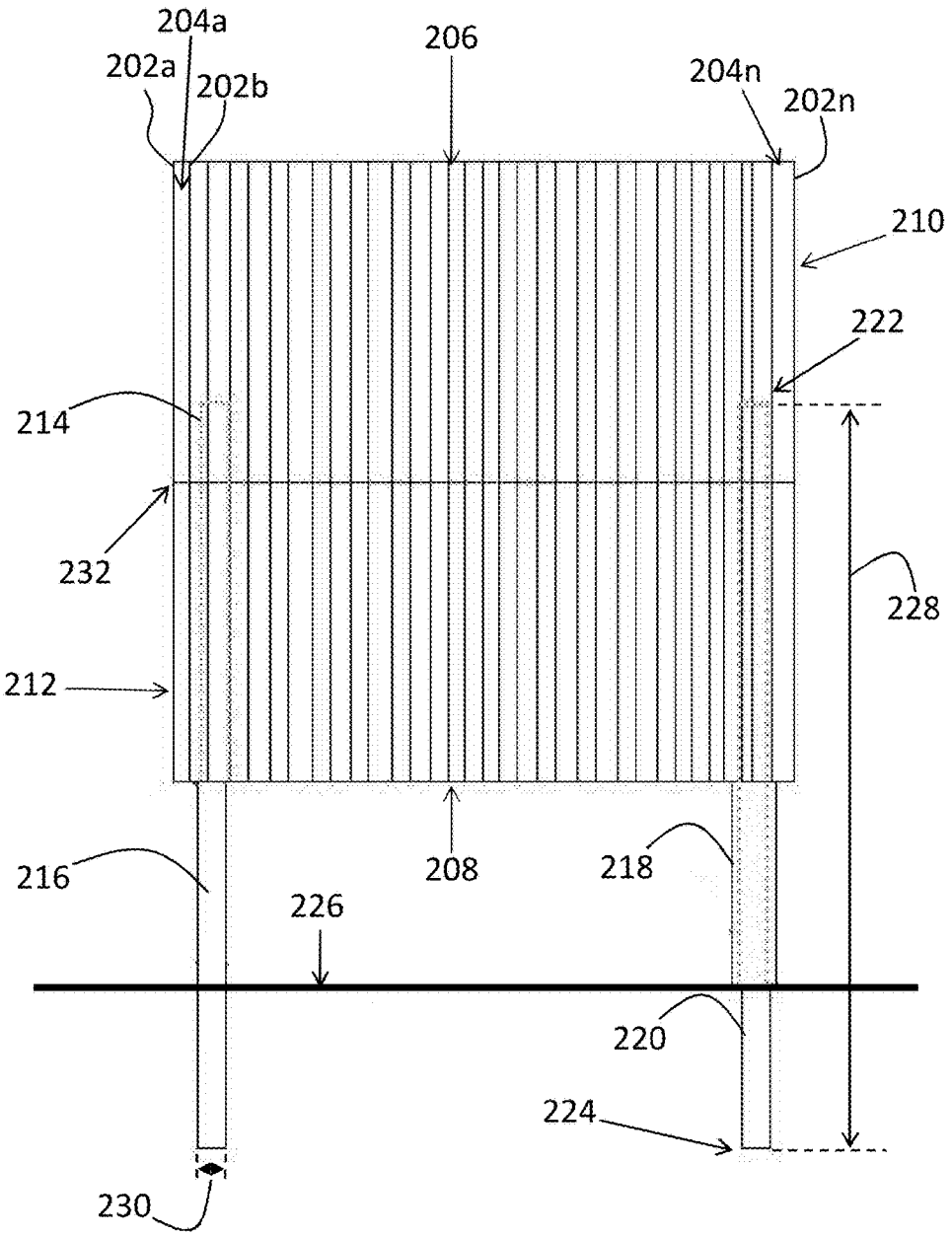
FIG. 2 is a fragmentary elevational front view of a corrugated sign having a plurality of first-sized channels and an enlarged channel occupied by a post-like member staked into the ground in accordance with an embodiment of the present invention.
Figure 3:
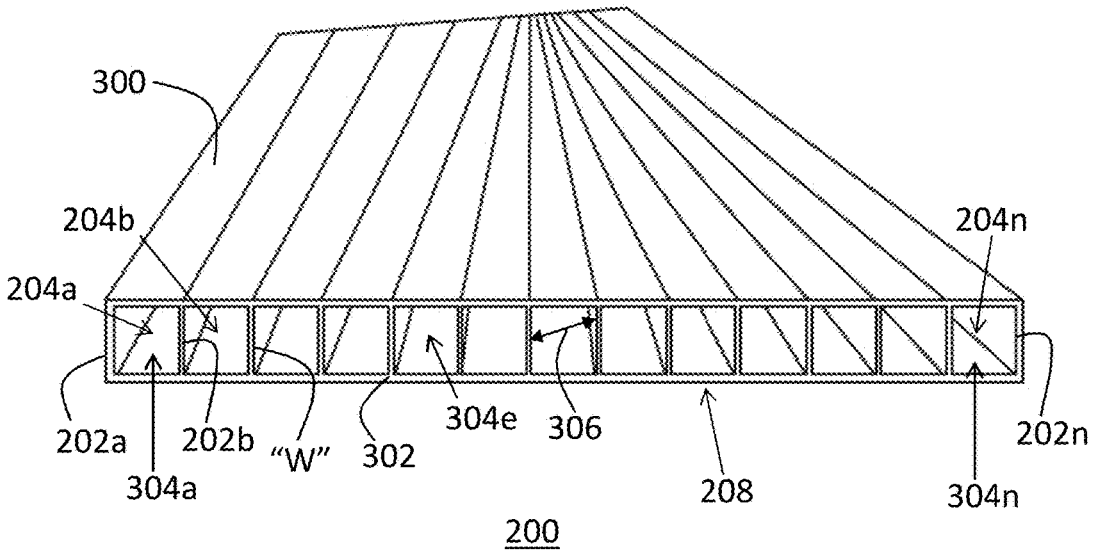
FIG. 3 is a downward-looking perspective view of the lower end of the sign of FIG. 1 in accordance with an embodiment of the present invention.

With reference now to FIGS. 2 and 3, one exemplary result of the present invention is shown in a fragmentary front elevational view and a downward-looking perspective lower end view, respectively. FIG. 2 shows several advantageous features of the present invention, but, as will be described below, the invention can be provided in several shapes, sizes, combinations of features and components, and varying numbers and functions of the components. The first example of modifying a corrugated sign 200 is illustrated in FIG. 2. The outer surface of the sign in FIG. 2 is removed depicting the walls 202*a-n* at least partially defining the plurality of channels 204*a-n*. The exemplary sign board 200, however, may be used for advertising, announcing, providing public notice, or displaying any other message, image, or other indicia. The outer surface 300 and inner surface 302 of the sign 200 can be seen depicted in FIG. 3. In some embodiments, one or more of the outer and inner surfaces 300, 302 include printed indicia and may be substantially planar. "Substantially planar" is defined as being a generally flat surface that may include a slight curvature that is either concave or convex in nature. In other embodiments, only of the outer surface 300 includes printed indicia communicating a message to the viewing public. This may include, without limitation, advertisements, colors of a flag, text, numbers, or images. The printed indicia may be formed with printers, ink, or another medium.

Figure 4:
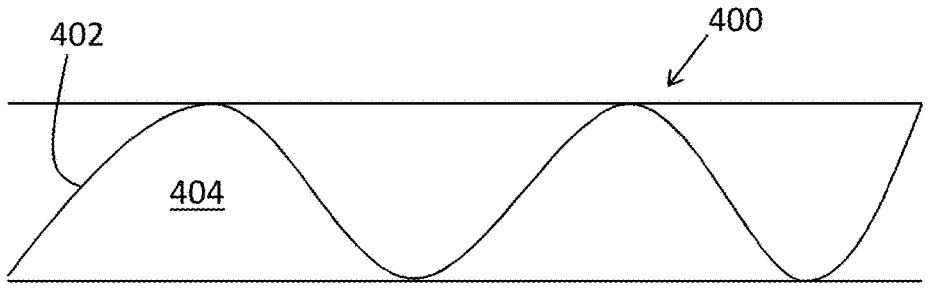
FIG. 4 is a fragmentary cross-sectional view of a corrugated sign structure in accordance with an embodiment of the present invention.

The components of the sign 200 may be formed with a polymer-based material, paperboard, cardboard, composites, or any combination/similar material of the above. The sign 200 may be formed from a single material or a combination of materials, such as plastic and cardboard. The sign 200 includes an upper end 206, a lower end 208, and opposing side edges 210, 212. The upper end 206 of the sign 200 defines a plurality of upper openings. The sign 200 can also be seen with a plurality of lower openings 304*a-n* defined by sign 200, e.g., the walls 202*a-n*, outer surface 300. In one embodiment, the corrugated structure of the sign 200 is as illustrated in FIG. 3. With brief reference to FIG. 4, in other embodiments the corrugated structure of the sign 400 may include any type of shape or design of the wall 402 that at least partially defines a channel 404, wherein the wall 402 is of a material that can be cut with a cutting device as depicted in FIGS. 5*a-g*.

FIG. 2 illustrates, though the hash lines 214, a post-like member 216 inserted within the sign 200. In one embodiment, the post-like member 216 is a slender polymeric or metallic-based material that is cylindrical in shape. "Slender" is defined as having a length generally longer than a traverse cross-sectional width along the length. The post-like member 216 may take the form of any elongated structure of a generally oblong shape. The post-like member 216 may be a unitary post of a width greater than those standard-sized channels 204. In other embodiments, the post-like member 216 may be a cover 218 that is placed on a standard-sized post 220 that is provided with a sign 200. Said another way, the post-like member 216 may include any structure of a sufficient width sized to be securely retained within an enlarged channel after the sign 200 is modified in accord with present invention. The post-like members 216 may be formed with PVC, electrical conduit tubing, fence railing (with or without swaged ends), or the like. As seen in FIG. 2, the post-like member 216 has a proximal end 222, a distal end 224 that is staked into the ground 226, and length 228 separating the proximal end 222 and distal end 224. The post-like member 216 may also include a width 230 along the post-like member length 228. After cutting the material from one of walls 202*a-n*, an enlarged channel is created and the proximal end 222 of the post-like member 216 is inserted in the sign 200. In other embodiments, the post-like member 216 is inserted in the ground 226 first and then the sign 200 is modified and placed on the post-like member 216.

In some embodiments, one of the plurality of walls 202*a-n* is modified by cutting a portion of the wall, e.g., 202*b*, with a cutting device 500 to create a channel that is larger than all of the plurality of channels 204*a-n*. The cutting device 500 may be one of those exemplary devices shown in FIGS. 5*a-g*. Taking FIG. 5*a* as an example, each cutting device 500 has a first end 502, a second end 504, a handle length 506 separating the first end 502 and second end 504, and a blade member 508 coupled along the handle length 506. In accordance with the present invention, one of the plurality of walls 202*a-n* is modified by cutting a portion of the wall, e.g., 202*b*, with the blade member 508 to combine two of the plurality of channels 204*a-n* (i.e., 204*a-b*) adjacent to the cut portion (i.e., 202*b*) to create an enlarged channel (not shown). This advantageously permits a post-like member 216, being of a larger size than most posts provided with signs, to be inserted within the sign 200 efficiently and effectively without damaging more of the internal structure of the sign 200 than necessary. The larger post-like member 216 allows the sign 200 to be more stable than those known signs available in the art. Beneficially, the cutting device 500 and the post-like member 216 may be provided together in a kit sold to consumers to modify most, if not all, corrugated signs with an internal wall structure being of a material that can be cut with the blade member 508.

Figure 7:
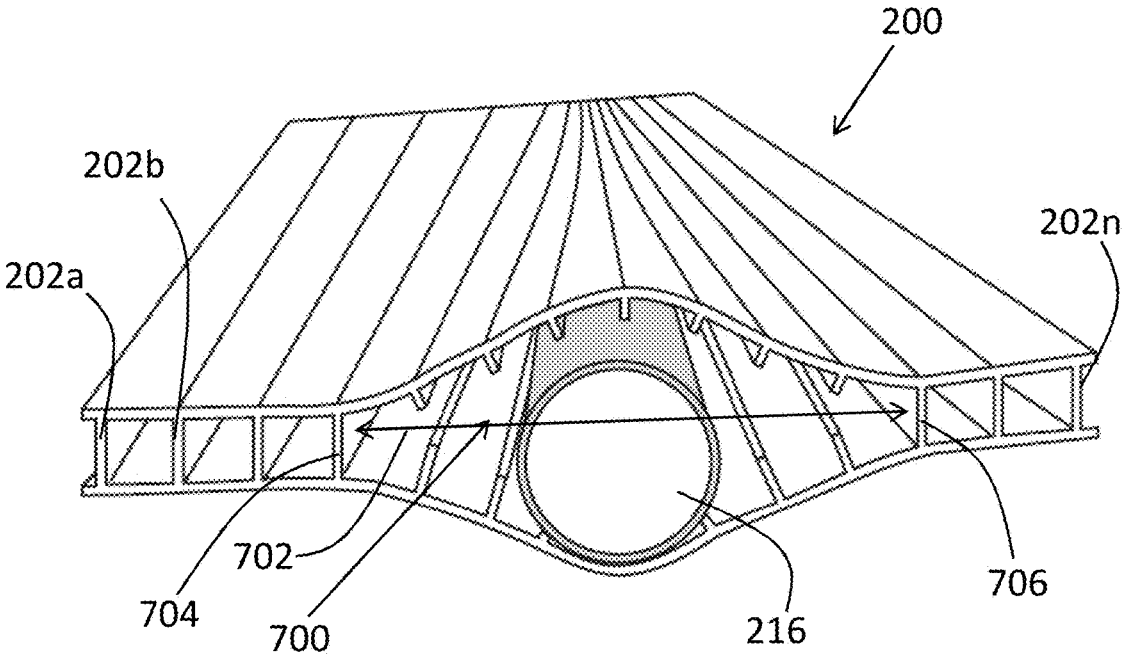
FIG. 7 is a downward-looking perspective view of the lower end of the sign of FIG. 1 with a post-like member inserted therein in accordance with an embodiment of the present invention.

With reference to FIGS. 2, 3, 5*a*, and 7, one or more of the walls 202*a-n*, that is considered to be interior (e.g., 202*b*), is modified with a blade or "cutting edge" 510 that traverses the plane of one of the plurality of walls 202*a-n* at a point between the width "W". The blade 510 is placed against an edge of one of the walls 202*a-n*. The blade 510 is forced from the lower end 208 of the sign 200 towards the upper end 206 of the sign 200, thereby splitting one or more of the walls 202*a-n* into opposing projections (as shown in FIG. 7). The blade 510 is then moved down towards the lower end 208 and removed from the newly created second-sized channel 700 (also referred to herein as the enlarged channel). The blade 510 may be removed from the upper end 206 of the sign 200 or the lower end 208 of the sign 200. The blade 510 should not cut through the outer or inner surfaces 300, 302, when forming the second-sized channel 700. One or more of the walls 202*a-n* that are cut may also have a beveled edge. In an embodiment, one of the walls 202*a-n* are cut with a beveled channel cutter tool that creates the pair of opposing projections may have reciprocating beveled edges.

Figures 5A, 5B, 5C, 5D, 5E, 5F, 5G:
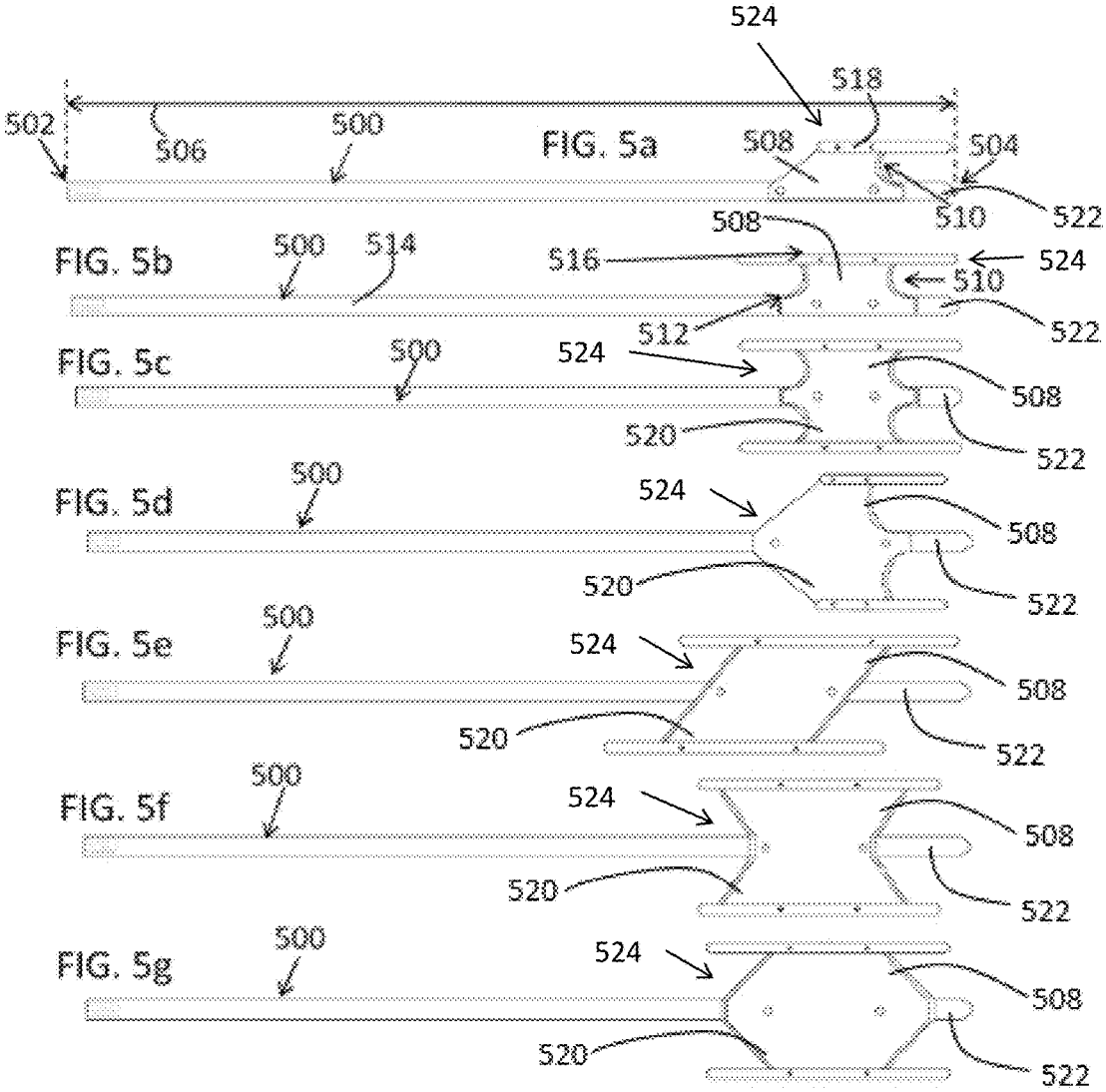
FIGS. 5*a-g* are elevational front views of cutting devices utilized to modify the corrugated sign of FIG. 1 to create the enlarged channel in accordance with embodiments of the present invention.
Figures 6A, 6B, 6C, 6D:
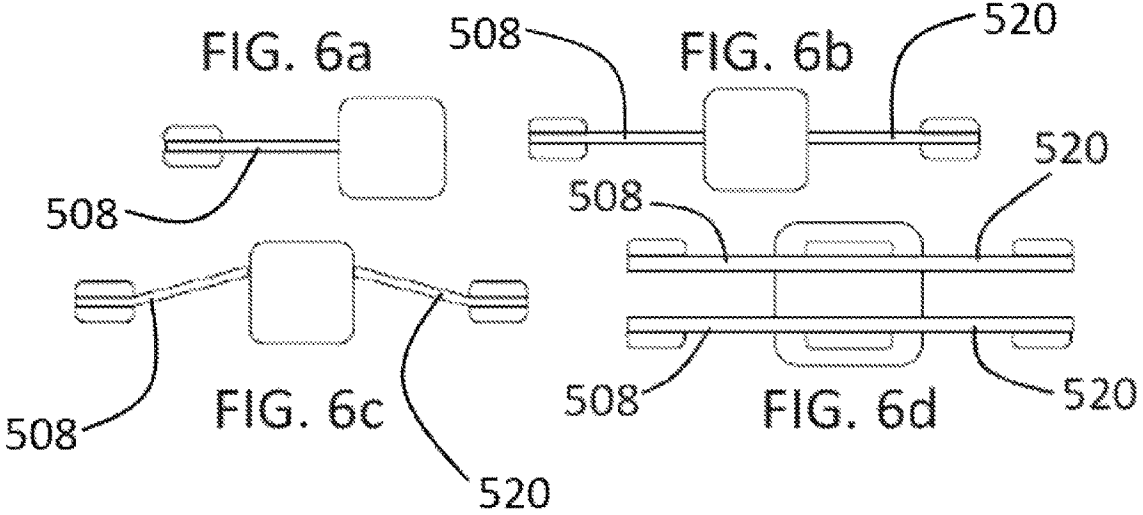
FIGS. 6*a-d* are top plan views of the exemplary cutting devices in FIGS. 5*a-g* in accordance with embodiments of the present invention.

With reference to FIGS. 5*a-b* as an example, the blade member 508 includes a proximal end 512 coupled to a handle 514 along the handle length 506, a distal end 516, and the cutting edge 510 separating the proximal and distal ends 512, 516, the cutting edge 510 facing in the longitudinal direction of the handle 514 (as shown in FIG. 5*a*). The cutting device 500 is assembled various components such that the blade member 508 is coupled to the handle 514 with fasteners. The blade member 508 may be removable or may be permanently affixed onto the handle 514. In other embodiments, the components of the cutting device 500 are formed from one piece of material such that no assembly is required. The blade member 508 can be seen extending outwardly away from the handle 514 and has a width separating the proximal and distal ends 512, 516 (i.e., the outer extent of the blade member 508 and the location where the member 508 couples with the handle 514). In one embodiment, the width of the blade member 508 is less than approximately 1 inch to permit the blade member 508 to effectively enter and egress without damaging the other components of the corrugated sign 200. In other embodiments, the width of the blade member 508 is sized to smaller than the smallest of the plurality of channels 204*a-n* or may be sized to cut two or more of the plurality of walls 202*a-n*.

The blade member 508 may include a center guide portion 522 sized to fit into one of the first-sized channels of the corrugated sign boards 200 discussed above. In some embodiments, a threaded portion is substituted or included within the handle 514 to allow the corrugated sign board tool 500 to mate with a machine tool for machine-driven cutting of one of the walls 202*a-n* or for an extension tool 900 shown in FIG. 9 or grips 1000 shown in FIG. 10. The shank or blade member 508 includes or otherwise mates with the handle 514 for gripping by a user. As mentioned, the total length of the cutting tool 500 may be increased or reduced in total length 506 and in some embodiments may utilize a locking telescoping function to quickly extend and retract the length, as required by the user. In one embodiment, the length 506 of the cutting device 500 is approximately 8-12". In other embodiments, the cutting device 500 is greater or less than 8-12" depending on the sign and sign for which the tool 500 is to be used. In further embodiments, the tool 500 may include a depth stopping device 1100 (shown in FIG. 11) that includes a portion 1102 removably fixedly couplable to the handle 514 and a width 1104 greater than the blade member 508 width. The width 1104 of the depth stopping device 1100 permits the tool 500 to be utilized to create uniform and accurate cuts on one or more of the walls 202*a-n*. Therefore, a user can advantageously traverse the tool 500 over one of the walls 202*a-n* until the depth stopping device 1100 is at least substantially adjacent (less than approximately 0.5") with a lower end 208 of the sign 200. As shown in FIG. 11, the device 1100 is slid up or down the handle 514 to dictate the desired depth for the enlarged channel 700 and is fixedly coupled to the handle through a clamp, screw or nut mechanism. Other tightening mechanisms are contemplated without deviating from the spirit and scope of the invention.

With reference back to FIGS. 5*a-g*, the cutting edge 510 of the blade member 508 may be ground to create a sharp edge for cutting. In some embodiments, the cutting edge 510 may be one of a curved, angled, or otherwise straight edge and may also be reversible by a user. The corrugated sign board tool 500 may also include one or more guide members 518 that are positioned to guide the cutting edge 510 against the interior walls 202*a-n* for guiding the blade 508. As seen in FIGS. 5*b-g*, one or more the blade members 508 may have multiple cutting edges 510 for cutting a plurality of walls 202*a-n*, both from the perspective of the upper end 206 or the lower end 208 of the sign 200. Each guide member 518 may be secured to both sides of the blade 508, or alternatively secured only to a single side of the blade 508. The guide members 518 are also configured for safety to prevent or otherwise limit an individual's extremities from unintentionally being cut against one or more of the cutting edges 510. In some embodiments, the guide members 518 include a rounded outer surface such that no portion of the outer facing surface is perpendicular to the plane of the blade 508. In some embodiments, when the outer surface of the guide members 518 are rounded, the guide members 518 do not have a top or bottom surface thereby reducing the frictional contact of the guide members 518 against the corrugated sign board 200 while cutting one or more of the walls 202*a-n*. The guide members 518 may be formed from metal, plastic, or any other known materials capable of protecting and guiding the cutting edges 510. The tool 500 may also be configured with any number of desirable cutting edges 510 to allow for cutting any number of interior walls 202*a-n* of a corrugated sign board 200 simultaneously. Additionally, blade 508 may also be altered as desired to cut and intersect a desired number of interior walls 202*a-n*.

In some embodiments, the blade 508 includes a plurality of opposing cutting edges 510 on a portion of the blade 508 which allows the user to reverse the blade 508 after the cutting edge 510 has dulled. Two or more guide members 518 may run parallel to each other beyond the opposing cutting edges 510. Alternatively, the guide members 518 may not be parallel or may be normal to a portion of the cutting edge 510. As shown in FIG. 5*c*, as an example, a structure 524 may include two blade members 508, 520 coupled along the handle length 506 wherein each blade member extends outwardly away from the handle 514 in an opposing orientation from one another. Said another way, each blade member 508, 520 is on opposite sides of the handle 514 with a +/−90 degree deviation of the blade members 508, 520. This orientation permits the members 508, 520 to cut a portion of two of the plurality of walls 202*a-n* with the blade members 508, 520 to combine two of the plurality of channels 204*a-n* adjacent to the cut portions of the two of the plurality of walls 202*a-n* to create an enlarged channel 700 (as shown in FIG. 7). While the blade members 508, 520 are illustrated as a razor-based assembly, the members 508, 520 may also be employed in the form of a scissor assembly or other assembly used to cut the internal walls 202*a-n* of the sign 200. The structure 524 may also include guide member 518 and center guide portion 522, as shown in FIGS. 5*a-5g*.

In some embodiments, the guide members 518 are adjustable laterally and may be releasably locked into place to prevent lateral movement while cutting the interior walls 202*a-n*. FIGS. 6*a-d* illustrate top plan views of the exemplary cutting tools 500 in FIGS. 5*a-g*. FIGS. 8*a-c* also illustrate side elevational views of the exemplary cutting tools 500 in FIGS. 5*a-g*. As exemplified by FIG. 6*d*, the blade members 508, 520 may be advantageously orientated and configured in various positions to maximize or dictate the amount material removed/cut from one or more of the plurality of walls 202*a-n*.

Referring now back to FIGS. 3 and 7, the sign 200 includes a corrugated structure with multiple first-sized channels 204*a-n* defined by the walls 202*a-n*. FIG. 3 depicts thirteen first-sized channels 204*a-n*, however, any desired number of first-sized channels 204*a-n* may be provided. In one embodiment, the walls 202*a-n* may be arranged substantially parallel to one another and may be symmetrically. In other embodiments, each of the walls 202*a-n* have independently or dependently varying widths "W". In some embodiments, there exist walls 202*a-n* that are not arranged parallel to all of the other walls, for creating different shaped channels, among one reason. The plurality of channels 204*a* may have a width 306 of approximately 0.25" and are substantially the same as one another (i.e., 5-10% deviation in length to one another). In other embodiments, the width 306 varies from 0.10" to 1" or larger, depending on the size and corresponding structure of the sign 200.

Moreover, the lower end 208 of the sign also defines the plurality of lower openings 304*a-n* with each having a lower opening width of substantially the same length to one another (i.e., 5-10% deviation in length to one another) and at least one enlarged opening 700 (as illustrated in FIG. 7). In one embodiment, the at least one enlarged opening 700 has a width approximately at least twice the length of a plurality of lower opening widths, with a lower opening width having approximately the same width of the channel width 306 to which it corresponds. In one embodiment, the at least one enlarged opening has a width approximately at least twice the length of each of the plurality of lower opening widths (and in some embodiments, all lower opening widths). The also applies with respect to the enlarged channel width 702. In further embodiments, the at least one enlarged opening 700 is juxtaposed with a plurality of lower openings. In other embodiments, the at least one enlarged opening 700 is juxtaposed on each side with the plurality of lower openings, depending on how many walls 202*a-n* are removed to create the enlarged opening 700.

In one embodiment, the post-like members 216 have portions that taper upwardly to be securely retained within the enlarged channel 700. The term "securely retained" is defined as firmly fastened at a particular location which may, but does not necessarily require, be removed with the application of force from a human hand (approximately 0.5-1 $lb_f$). In other embodiments, as shown in FIG. 2, the post-like member has one continuous width 230 (i.e., uniform) that extends along the post length 228 or may have sections with differently sized widths 230. Said another way, the post-like member 216 may also be greater than each of the two of the plurality of channels 204*a-n* (e.g., 204*a-b*) adjacent to the portion of the wall cut by the user. The post-like member 216 may also have a width 230 greater than any of the plurality of channels widths 306. In some embodiments, separating the first-sized channels 204*a-n*, via cutting one or more interior walls 202*a-n*, creates one or more opposing projections on the inward facing surface of the newly created second sized channel 700 as shown in FIG. 7.

In some embodiments, the projections shown in FIG. 7 are deformable such that inserting the post-like member 216 into the enlarged channel 700 (also referred to as a second sized channel) causes the projections to deform. In other embodiments, the projections are not deformable such that the projections will not bend in relation to the surface from which the proximal portion of the projections are attached. In some embodiments, the deformation of the projections increases the frictional coupling between the second-sized channel 700 and the post-like member 216. In other embodiments, inserting the post-like member 216 into the enlarged channel 700 distorts the shape of the corrugated structure of sign 200 corresponding to the enlarged channel 700 as shown in FIG. 7. Deformation may be defined to include bending, arcing, bowing, curving, leaning, shifting, turning, or twisting, of the projections. The projections are deformed against the post-like member 216 causing the sign board 200 to frictionally mate with the post 216.

In further embodiments, two of the plurality of walls 202*a-n* may be cut with the blade members 508, 520 to combine two of the plurality of channels 204*a-n* adjacent to the cut portions of the two of the plurality of walls 202*a-n* to create a channel with a third-sized width, the third-sized width being greater than the second-sized width 702. For example, while FIG. 7 depicts multiple walls that are cut by the user, the user may modify only one of the plurality of walls 202*a-n* such that an enlarged channel is created that is larger than any of the first-sized channels 204*a-n*. If a user cuts an additional wall adjacent to the enlarged channel an even larger sized channel is created. This process may continue until a desirous width of the enlarged channel is created. As referred to herein, the width 702 of the enlarged channel 700 is the diameter separating the outermost intact walls (i.e., 704, 706) of the sign 200 defining the channel.

Figure 12:
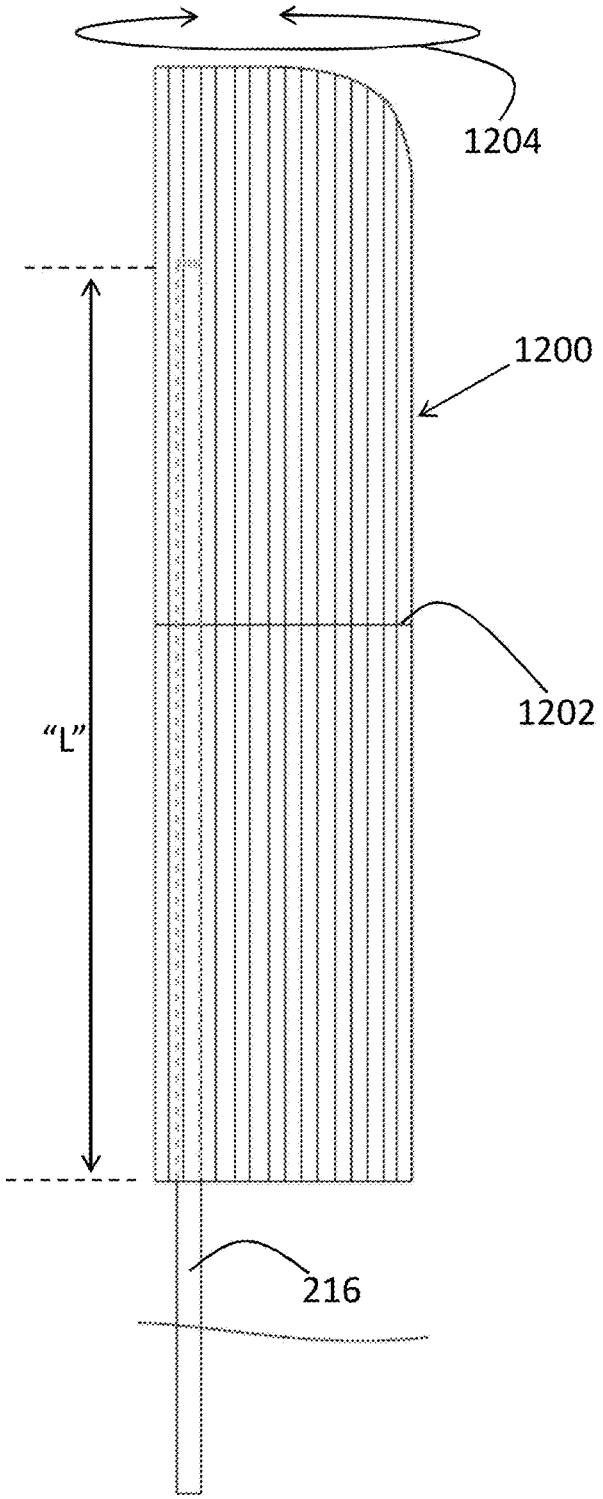
FIG. 12 is a fragmentary elevational front view of a corrugated sign in accordance with an embodiment of the present invention.

With reference now to FIG. 12, another embodiment of the present invention is shown. FIG. 12 depicts a sign or flag 1200 with an internal corrugated structure. As discussed above, the interior walls 202*a-n* may only be partially through the sign a length "L" to form a pocket. Each pocket is then configured to accept a post-like member 216 (e.g., a shaft, rod, or plank). Corrugated signs may be comprised of many different materials such as plastic or cardboard. Plastic is particularly useful for displaying outdoors because they signs have an estimated durability of over one (1) year and multiple years when displayed indoors. The 1200 may be configured to allow for easy shipping with, for example, accordion folds 1202. As such, the sign 1200 may be placed into a shipping position by folding the sign board 1200 along each of one or more fold lines 1202 thereby reducing the height and/or width of the sign board 1200. In one embodiment, the fold lines 1202 are formed by scoring one of the two opposing sign faces. In operation, a knife or other blunt object cuts across only one of the two opposing sign faces allowing the sign 1200 to fold such that the outer surface of the second sign face of the two opposing sign faces folds against itself. The pocket of the second-sized channel is configured to intersect the scored portion of the sign board 1200 such that when the post 216 is placed within the pocket, the sign board 1200 is in the display position and not the shipping position.

The post 216 may also permit the sign or flag 1200 to spin or swivel around the "z" axis (indicated by the direction arrow 1204). In particular, because the corrugated sign 1200 may rest on the post 216, held in place by gravity, wind forces may cause the corrugated sign 1200 to rotate about the post 216

Figure 13:
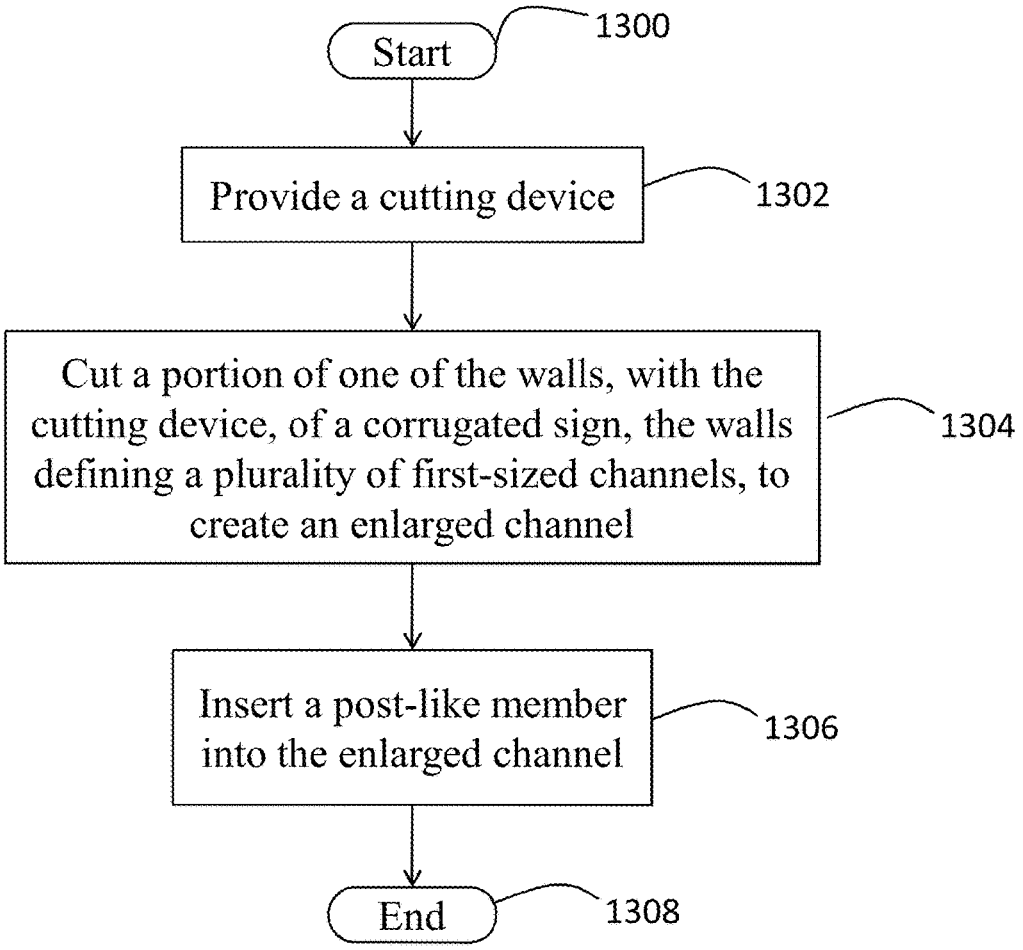
FIG. 13 depicts a process flow diagram illustrating a method of increasing the stability of a corrugated sign in accordance with the present invention.

FIG. 13 depicts a process flow diagram illustrating a method of increasing the stability of a corrugated sign with the above described structure. The method starts at step 1300 and immediately proceeds to step 1302 of providing a cutting device having a first end, a second end, a handle length separating the first and second ends, and a blade member coupled along the handle length. The process continues to step 1304 of cutting a portion of at least one of the plurality of walls with the blade member to combine two of the plurality of channels adjacent to the cut portion of the at least one of the plurality of walls to create an enlarged channel. This process may be carried out by an end user or by a manufacturer reselling these signs. Next, step 1306 includes inserting a post-like member into the enlarged channel, the post-like member being securely retained within the enlarged channel. This provides a method of assembling a sign structure that more reliable and resilient to inclement weather and has an increased impact resistance. In other embodiments, the process may include providing the aforementioned sign structure before step 1304 is carried out. The process then terminates in step 1308.

The present invention provides a novel and efficient method of modifying a sign having a corrugated structure with a plurality of first-sized channels by cutting the walls defining those first-sized channels with a special cutting device to create larger channel sized to receive a larger post than typically available on those known sign. The present invention may be carried out on any known corrugated structure intended to be supported with posts to generate a more stable and reliable structure than currently available.

What is claimed is:

1. A corrugated sign modification kit, the kit comprising:
- a post-like member configured to be inserted into a corrugated sign; and
- a handheld cutting device for cutting a portion of the corrugated sign, the handheld cutting device comprising:
  - an elongated handle with a proximal end and a distal end defining a longitudinal axis and a handle length;
  - a blade member coupled to the elongated handle and spaced from the distal end so that the elongated handle defines a center guide portion extending from the blade member to the distal end, the blade member having a cutting edge located between the proximal and distal ends and facing in a direction in line with the longitudinal axis of the elongated handle and towards the distal end; and
  - a first blade guide member coupled to the blade member, the first blade guide member defining a first guide member longitudinal axis that is substantially parallel to the longitudinal axis of the elongated handle.

2. The kit according to claim 1, wherein:
the post-like member includes:
- a distal end, a proximal end, and a post-like member length separating the distal and proximal ends of the post-like member; and
- a portion along the post-like member length with a width separating the outer-most extents of the post-like member that is greater than the length of the cutting edge.

3. The kit according to claim 2, wherein:
the post-like member length is of a length greater than the handle length.

4. The kit according to claim 1, wherein the post-like member further comprises:

a cylindrical shape.

5. The kit according to claim 1, wherein:

the cutting edge is of an arcuate shape.

6. The kit according to claim 1, further comprising:

a depth stopping device including a portion removably fixedly couplable to the elongated handle and having a width greater than a first blade member width.

7. The kit according to claim 1, wherein the cutting edge of the blade member is a first cutting edge, the blade member further comprises:

a second cutting edge opposite the first cutting edge about the longitudinal axis of the elongated handle, wherein the second cutting edge has a width of approximately 1 inch.

8. The kit according to claim 7, wherein:

the center guide portion is located between the first cutting edge of the first blade member and the second cutting edge.

9. The kit according to claim 7, further comprising:

a second blade guide member coupled to the blade member, the second blade guide member having a distal end and defining a second blade guide member longitudinal axis that is substantially parallel to the longitudinal axis of the elongated handle, and wherein the distal end of the second blade guide member protrudes in front of the first cutting edge.

10. The kit according to claim 9, wherein:

the distal end of the second blade guide member is rounded.

11. A handheld cutting device for cutting a portion of a corrugated sign, the handheld cutting device comprising:

an elongated handle with a proximal end and a distal end defining a handle longitudinal axis and a handle length;

a blade member coupled to the elongated handle and spaced from the distal end of the elongated handle so that the elongated handle defines a center guide portion extending from the blade member and defining the distal end of the elongated handle, the blade member having a first cutting portion with a first cutting edge located between the proximal and distal ends of the elongated handle and facing in a direction in line with the handle longitudinal axis towards the distal end of the elongated handle, the center guide portion being located between the first and second cutting edges; and a first blade guide member coupled to the first cutting portion, the first blade guide member defining a first blade guide member longitudinal axis that is substantially parallel to the handle longitudinal axis.

12. The handheld cutting device according to claim 11, further comprising:

a depth stopping device including a portion removably fixedly couplable to the elongated handle and a width greater than a first blade member width.

13. The handheld cutting device according to claim 11, further comprising a second blade guide member coupled to the second cutting portion, the second blade guide member having a distal end and defining a second blade guide member longitudinal axis that is substantially parallel to the handle longitudinal axis and the distal end of the second blade guide member protruding in front of the first cutting edge.

* * * * *